US009219337B2

(12) United States Patent
Hanses

(10) Patent No.: US 9,219,337 B2
(45) Date of Patent: Dec. 22, 2015

(54) JUMPER AND JUMPER TERMINAL ARRANGEMENT

(75) Inventor: Markus Hanses, Höxter (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 345 days.

(21) Appl. No.: 13/581,774

(22) PCT Filed: Mar. 1, 2011

(86) PCT No.: PCT/EP2011/052986

§ 371 (c)(1),
(2), (4) Date: Aug. 29, 2012

(87) PCT Pub. No.: WO2011/107457

PCT Pub. Date: Sep. 9, 2011

(65) Prior Publication Data

US 2012/0329315 A1 Dec. 27, 2012

(30) Foreign Application Priority Data

Mar. 1, 2010 (DE) ..... 10 2010 009 805

(51) Int. Cl.

| | |
|---|---|
| ***H01H 9/26*** | (2006.01) |
| ***H01R 13/703*** | (2006.01) |
| ***H01R 31/08*** | (2006.01) |
| *H01R 43/24* | (2006.01) |

(52) U.S. Cl.
CPC ..... *H01R 13/7032* (2013.01); *H01R 31/08* (2013.01); *H01R 43/24* (2013.01)

(58) Field of Classification Search
CPC ..... H01R 13/6582; H01R 9/0524; H01R 9/2441; H01R 9/26; H01R 9/2675
USPC ..... 439/507
See application file for complete search history.

(56) References Cited

U.S. PATENT DOCUMENTS

| | | | | |
|---|---|---|---|---|
| 2,634,311 | A * | 4/1953 | Darling | H01R 13/005 15/314 |
| 4,501,459 | A | 2/1985 | Chandler et al. | |
| 4,516,817 | A * | 5/1985 | Deters | H01R 31/08 439/387 |
| 4,582,376 | A * | 4/1986 | Olsson | 439/514 |
| 6,341,967 | B1 | 1/2002 | Nabeshima et al. | |
| 7,094,073 | B2 | 8/2006 | Obata et al. | |
| 7,252,534 | B2 * | 8/2007 | Reibke | H01R 4/2433 439/404 |
| 7,390,230 | B1 * | 6/2008 | Chen | H01R 31/08 439/875 |
| 7,845,969 | B2 | 12/2010 | Stadler et al. | |
| 8,647,157 | B2 * | 2/2014 | Gan | H01R 9/2675 439/507 |
| 2005/0095904 | A1 * | 5/2005 | Reibke et al. | 439/507 |

(Continued)

FOREIGN PATENT DOCUMENTS

| | | | |
|---|---|---|---|
| AU | 2004325908 | B2 | 6/2006 |
| DE | 6602247 | U | 4/1969 |
| DE | 10 2006 051 774 | A1 | 5/2008 |
| GB | 2 228 633 | A | 8/1990 |
| JP | 4-76274 | U | 7/1992 |

(Continued)

*Primary Examiner* — Truc Nguyen
(74) *Attorney, Agent, or Firm* — Roberts Mlotkowski Safran & Cole, PC; David S. Safran

(57) ABSTRACT

A jumper for a connecting terminal arrangement (34) having a contact element (12), which has a contacting area (16) and a holding area (18), and a holding element (14) made from an insulating material is arranged on the holding area (18). The holding area (18) has a perforation (22) which is penetrated by the insulating material of which the holding element is made (14).

5 Claims, 2 Drawing Sheets

(56) References Cited

U.S. PATENT DOCUMENTS

| | | | | |
|---|---|---|---|---|
| 2008/0009203 | A1* | 1/2008 | Pizzi | H02B 1/205 439/876 |
| 2013/0217276 | A1* | 8/2013 | Bentler | H01R 9/26 439/716 |

FOREIGN PATENT DOCUMENTS

| | | | |
|---|---|---|---|
| JP | 10-003972 | A | 1/1998 |
| JP | 2001-167838 | A | 6/2001 |
| JP | 2005-71612 | A | 3/2005 |
| JP | 2008-193763 | A | 8/2008 |

* cited by examiner

JUMPER AND JUMPER TERMINAL ARRANGEMENT

BACKGROUND OF THE INVENTION

1. Field of the Invention

The invention concerns a jumper for a connecting terminal arrangement.

2. Description of Related Art

Jumpers can be provided, for example, for the electrical connection of several connecting terminals arranged in a connecting terminal arrangement. For this, a connecting terminal arrangement usually has a housing with one or more jumper insert openings, in which the jumpers can be introduced, for example, to connect the bus bars of two or more terminals to each other to make contact.

Such jumpers are preferably detachable in a connecting terminal arrangement, the jumpers being made from a contact element fashioned from a conducting material, especially, a metal, which has a contact area for making a contact and a holding area on which is arranged a holding element made from an insulating material, i.e., a nonconducting material, by which the jumpers can be introduced into and removed from a jumper insertion opening using a tool. The holding element is usually clamped onto the holding area of the contact element, while it may happen that the holding element gets loose from the contact element and the contact element by itself remains in the jumper insertion opening and it then very hard to remove from the jumper insertion opening once again.

SUMMARY OF THE INVENTION

The object of the invention is therefore to provide a jumper characterized by improved handling and functionality.

The object of the invention is achieved by the features and advantageous embodiments of the invention described herein.

The jumper of the invention for a connecting terminal arrangement has a contact element, which has a contacting area and a holding area, wherein a holding element made from an insulating material is arranged at the holding area, and according to the invention the holding area has a perforation which is penetrated by the insulating material of the holding element.

In this way, it is possible to realize an especially secure and stable fastening of the holding element to the contact element. The perforation extends preferably over the entire length of the holding area and is preferably formed by several through holes arranged alongside each other. The holding element is preferably formed in a U-shape in the area that is connected to the contact element, so that the holding element encloses the contact element at the holding area. When fastening the holding element to the contact element, the insulating material of the holding element is converted to a fluid condition, so that the insulating material can flow through the holes of the perforation and harden inside the perforation when the insulating material cools down, so that the insulating material is arranged about the outer surface of the holding area of the contact element and inside the perforation, so that a film material connection of the insulating material is achieved between the insulating material on the two outside surfaces of the holding area. In this way, one can safely prevent an unwanted slipping of the holding element off from the contact element.

According to another advantageous embodiment of the invention, the holding area has the insulating material of the holding element injection-molded around it. The insulating material for this is preferably made from a plastic material, while the holding element can be made by means of an injection molding method and be molded or injected around the holding area of the contact element. This enables a simple arrangement of the holding element on the contact element, and in particular, the insulating material can be easily introduced into the perforation of the holding area, especially by injection.

Furthermore, it is preferable that the holding element have a fixation element for fixation of the jumper, especially to a connecting terminal arrangement. With the fixation element, an unwanted slipping out of the jumper from the jumper insertion opening can be prevented. For this, the fixation element is preferably arranged or molded onto the outer surface of the holding element so that the fixation element can be brought into engagement with the housing of the connecting terminal arrangement inside the jumper insertion opening for the fixation. Preferably, two fixation elements are provided for this, which are mirror images of each other, in order to realize an especially secure and uniform fixation of the jumper inside a jumper insert opening.

The fixation element is provided preferably in the form of a convexity on the outer surface of the holding element. The convexity can engage, for example, in a groovelike opening provided inside the jumper insertion opening on the housing of the connecting terminal arrangement for the fixation. The convexity preferably extends over the entire lengthwise surface of the holding element. The convexity can advantageously be formed from the insulating material of the holding element, so that the fixation element in the form of the convexity can be joined as a single piece to the holding element and it can be molded along with the holding element.

The holding element, moreover, can preferably have an engaging area for a tool. In this way, the jumper can easily be removed by means of a tool, such as a screw driver, from the jumper insert opening. The engaging area is preferably provided on the holding element, opposite the receiving area of the contact element in the holding element. The engaging area can preferably be fashioned in the form of a groovelike opening along the lengthwise surface of the holding element.

According to another preferred embodiment, the contact element is fashioned as a rail. Thanks to the rail configuration, a uniform flat contacting surface is made possible as the contacting area, which can extend across two or more connecting terminals to produce an electrical connection. Thanks to the rail configuration, an especially easy handling is possible when introducing the jumper, especially the contact element of the jumper, into the jumper insertion opening and when removing the jumper from the jumper insert opening, which is especially distinguished from a jumper with several contact fingers as the contact element, since such a configuration with contact fingers can easily tilt and thereby get jammed, especially when inserting it. Nevertheless, it is also possible to fashion the contact element with one or more contact fingers.

The invention moreover concerns a connecting terminal arrangement with a housing, inside of which a jumper insertion opening is provided to receive a jumper configured and modified as above.

Preferably, a spring element is provided on the housing in the area of the jumper insertion opening for the fastening of the jumper in the jumper insert opening. The spring element is preferably configured as a spring arm, which is arranged on the housing in the insertion area of the jumper insert opening. The spring element is preferably part of the housing. By means of the spring element, a slight clamping of the jumper in the jumper insertion opening can already be accomplished in that the spring element is lengthened when the jumper is inserted to open up the insert opening of the jumper insert opening, and the spring element can apply a tension or a spring force to the inserted jumper, by means of which the jumper can be clamped in the jumper insert opening.

Moreover, advantageously, the spring element has an opening in which the fixation element of the holding element of the jumper can engage. When the jumper is introduced into the jumper insert opening, preferably the fixation element of the holding element can hook into the opening so as to ensure a secure positioning of the jumper in the jumper insert opening. The opening can be fashioned in the shape of a groove, which is adapted to the shape of the fixation element.

The invention is explained more closely hereafter making reference to the accompanying drawings showing a preferred embodiment.

DETAILED DESCRIPTION OF THE INVENTION

Figure 1:
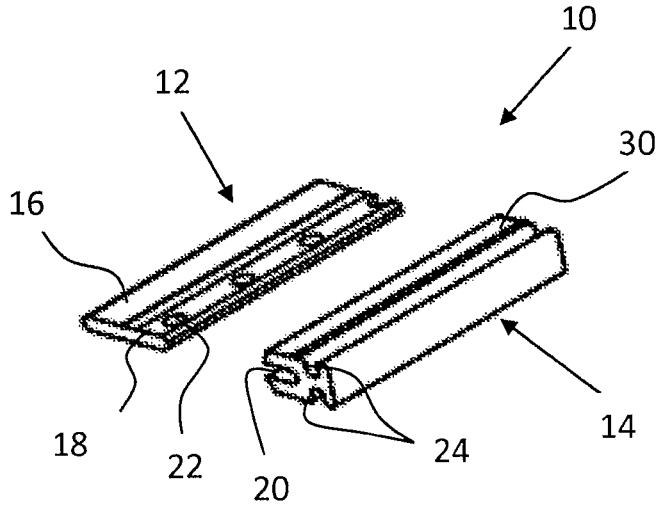
FIG. 1 is an exploded schematic representation of a jumper according to the invention.

FIG. 1 shows a schematic representation of a jumper 10 according to the invention, which has contact element 12 made from a metal, preferably copper, and a holding element 14 made from a nonconducting insulating material, wherein the contact element 12 in the representation shown here is not yet assembled with the holding element 14. The holding element 14 has a U-shaped portion with an opening 20 which, in the assembled state of the holding element 14 on the contact element 12, at least partly surrounds the contact element 12. The contact element 12 has a contacting area 16 to make an electrical connection and a holding area 18, on which the holding element 14 can be arranged. The holding area 18 has a perforation 22 formed of several adjacent through holes, which are preferably arranged with a uniform spacing from one to another. The joining of the contact element 12 to the holding element 14 is preferably performed by bringing the insulating material of the holding element 14 to a fluid state, so that the insulating material can flow through the holes of the perforation and harden inside the perforation 22 when the insulating material cools down, so that the insulating material is arranged about the outside surfaces of the holding area 18 of the contact element 12 and inside the holes of the perforation 22, so that a firm and intimate connection of the insulating material between the insulating material and the two outside surfaces of the holding area 18 is achieved. This can be accomplished, for example, during the production of the holding element 14, by molding it around the holding area 18 of the contact element 12, whereupon the fluid insulating material during the injection molding can penetrate into the perforation 22 and fill it up.

Figure 2:
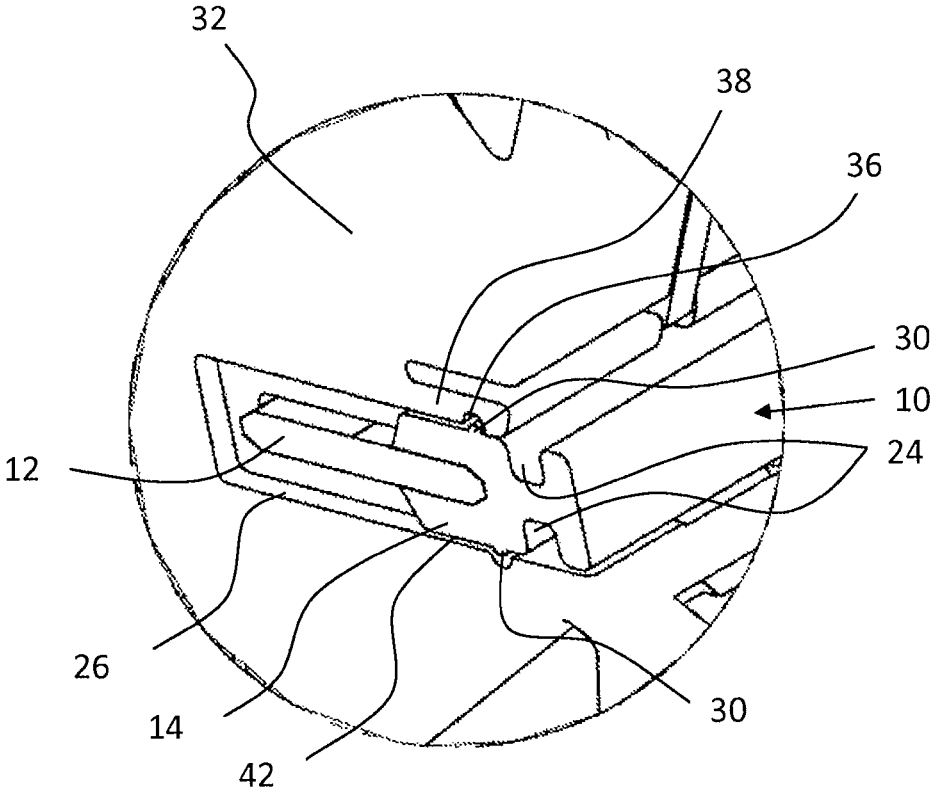
FIG. 2 is an enlarged schematic representation of a portion of the jumper shown in FIG. 1, introduced into a jumper insert opening.
Figure 3:
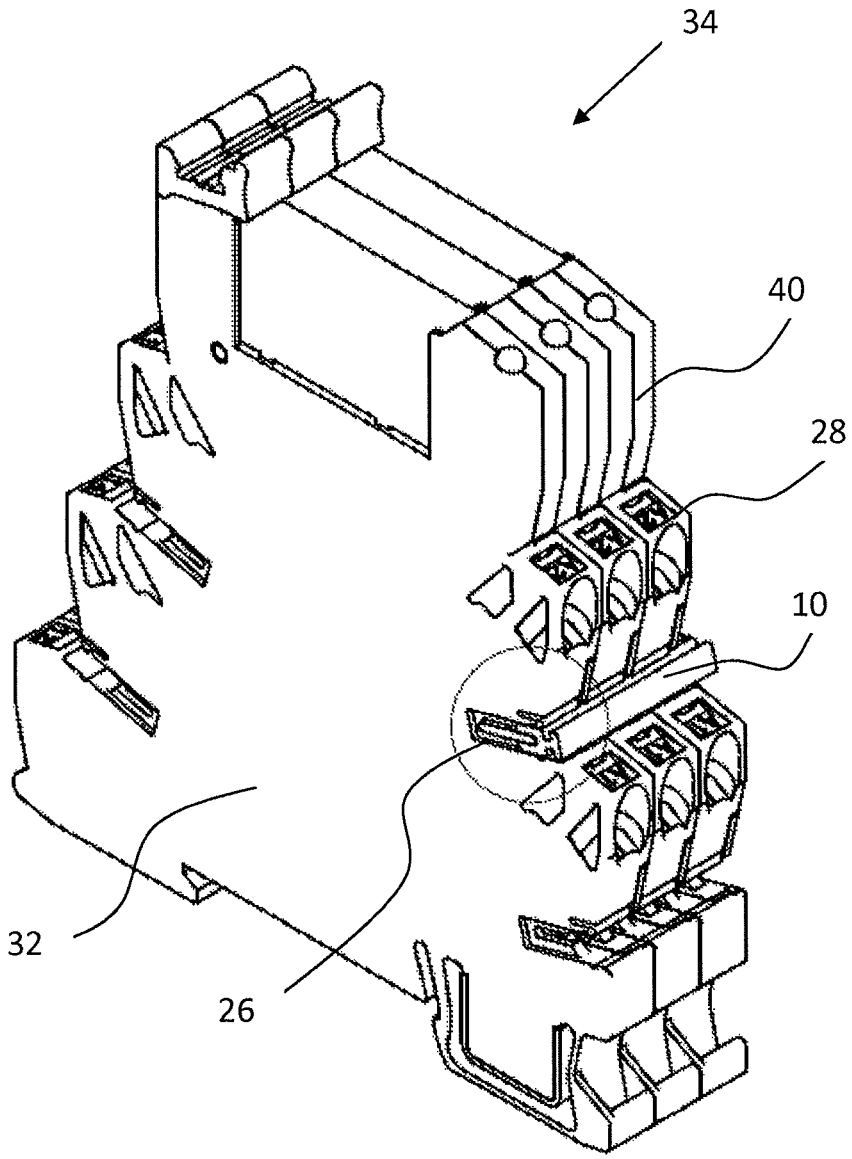
FIG. 3 is a schematic representation of a connecting terminal arrangement with a jumper according to FIG. 1 arranged therein.

The holding element 14 shown here, moreover, has an engaging area 24 in the form of an oblong groove, in which a tool can engage in order to easily remove the jumper 10 from a jumper insertion opening 26, as shown in FIGS. 2 & 3. In the embodiment shown here, the holding element 14 has two engaging areas 24, which are mirror images of each other and provided on the outer surface 42 of the holding element 14.

The contact element 12 in the embodiment shown here is configured as an elongated rail, by which the contact element 12 can electrically interconnect several adjacent connecting terminals 28, as shown in FIG. 3.

FIG. 2 shows the jumper 10 according to the invention in an assembled state, i.e., the holding element 14 has been molded on the contact element 12, and the jumper 10 is introduced into a jumper insertion opening 26 to produce an electrical connection. Two mirror-image fixation elements 30 are provided on the outer surface 42 of the holding element 14, being configured in this embodiment as an elongated convexity and joined as a single piece to the holding element 14. The fixation elements 30 serve to secure the jumper 10 in the jumper insertion opening 26, while the fixation elements 30 can engage with or hook into openings 36 formed on the housing 32, for example, of a connecting terminal arrangement 34, in the area of the jumper insertion opening 26, preferably groove-shaped openings. One of the openings 36 is provided on a spring element 38, which is preferably fashioned as a spring arm, and the spring element 38 is preferably part of the housing 32. Thanks to the spring element 38, a slight clamping can already be exerted on the inserted jumper 10 in that the spring element 38 presses on the outer surface 28, especially the outer surface 42 of the holding element 14, of the jumper 10.

FIG. 3 shows a connecting terminal arrangement 34 in which several disk-shaped modules 40, which have several connecting terminals 28, are placed together on a carrier rail, not shown here. FIG. 3 shows a jumper 10 which is arranged in a jumper insertion opening 26 of the connecting terminal arrangement 34 and which electrically interconnects three connecting terminals 28 of different modules 40 arranged one after the other in the sample embodiment shown here.

What is claimed is:

1. Jumper for a connecting terminal arrangement (34), comprising a contact element (12), which has a contacting area (16) and a holding area (18), wherein a holding element (14) made from an insulating material is arranged at the holding area (18), wherein the holding area (18) has a perforation (22) which is penetrated by the insulating material of the holding element (14), wherein the holding element (14) has a fixation element (30) for fixation of the contact element (12) in an insertion opening of a connecting terminal arrangement and wherein the fixation element (30) is formed as a convexity on at least one outer surface (42) of the holding element (14), wherein said convexity extends over an entire lengthwise surface of the holding element.

2. Jumper according to claim 1, wherein the holding area (18) has been penetrated by the insulating material of the holding element (14) by the insulation material having been molded around it.

3. Jumper according to claim 1, wherein the holding element (14) has an engaging area (24) for a tool.

4. Jumper according to claim 1, wherein the contact element (12) is configured as a rail.

5. Connecting terminal arrangement, comprising:

at least one jumper, at least one housing (32), inside of which a jumper insertion opening (26) is provided to receive the at least one jumper (10), wherein the at least one jumper comprises:

a contact element (12), which has a contacting area (16) and a holding area (18), wherein a holding element (14) made from an insulating material is arranged at the holding area (18), wherein the holding area (18) has a perforation (22) which is penetrated by the insulating material of the holding element (14), wherein the holding element (14) has a fixation element (30) for fixation of the contact element (12) in said jumper insertion opening, wherein the fixation element (30) is formed as a convexity on at least one outer surface (42) of the holding element (14). and wherein the at least one housing comprises:

at least one spring element (38) having an opening (36) positioned for engaging on the fixation element (30) of the holding element (14) of a respective jumper (10) inserted into a respective jumper insertion opening (26), wherein said convexity extends over an entire lengthwise surface of the holding element and is engageable in a groove-shaped opening provided inside the jumper insertion opening on said at least one housing.

* * * * *